US006115453A

United States Patent [19]

Hell et al.

[11] Patent Number: 6,115,453

[45] Date of Patent: Sep. 5, 2000

[54] DIRECT-HEATED FLATS EMITTER FOR EMITTING AN ELECTRON BEAM

[75] Inventors: Erich Hell; Detlef Mattern, both of Erlangen; Peter Schardt, Roettenbach, all of Germany

[73] Assignee: Siemens Aktiengesellschaft, Munich, Germany

[21] Appl. No.: 09/137,481

[22] Filed: Aug. 20, 1998

[30] Foreign Application Priority Data

Aug. 20, 1997 [DE] Germany ..... 197 36 213

[51] Int. Cl.[7] ..... H01J 35/06

[52] U.S. Cl. ..... 378/136; 378/113; 378/121; 378/173; 378/146; 430/942

[58] Field of Search ..... 430/942; 436/173; 378/113, 121, 145, 136; 313/346 R, 341, 344

[56] References Cited

U.S. PATENT DOCUMENTS

| | | | |
|---|---|---|---|
| 2,919,373 | 12/1959 | Riley et al. . | |
| 3,745,403 | 7/1973 | Misumi . | |
| 3,867,637 | 2/1975 | Braun et al. | 378/121 |
| 3,992,633 | 11/1976 | Braun et al. | 378/121 |
| 4,679,219 | 7/1987 | Ozaki | 378/121 |
| 4,730,353 | 3/1988 | Ono et al. . | |
| 4,764,947 | 8/1988 | Lesensky . | |
| 4,777,642 | 10/1988 | Ono . | |
| 5,170,422 | 12/1992 | Fiebiger . | |
| 5,343,112 | 8/1994 | Wegmann et al. . | |
| 5,703,924 | 12/1997 | Hell et al. . | |
| 5,878,110 | 3/1999 | Yamamoto . | |
| 5,895,736 | 4/1999 | Nakajima | 430/942 |

FOREIGN PATENT DOCUMENTS

| | | |
|---|---|---|
| 978.627 | 4/1951 | France . |
| 58.949 | 4/1954 | France . |
| OS 37 17 974 | 1/1988 | Germany . |
| 1011398 | 11/1965 | United Kingdom . |

OTHER PUBLICATIONS

Curry III, Dowdey, Murry. Jr, Christensen's Physics of Diagnostic Radiology 1990 pp. 28–30.

*Primary Examiner*—David P. Porta
*Assistant Examiner*—Pamela R. Hobden
*Attorney, Agent, or Firm*—Hill & Simpson

[57] ABSTRACT

A direct-heated flat emitter for generating a homogenous electron beam, particularly for x-ray tubes, has two terminal lugs for the heating current supply formed at the edge of the perimeter of the emission surface and the emission surface is subdivided into interconnects by slits. The slits have a width no less than 10 $\mu$m and no greater than 1% of the length of a diagonal of the smallest rectangle which can circumscribe the emission surface.

16 Claims, 1 Drawing Sheet

DIRECT-HEATED FLATS EMITTER FOR EMITTING AN ELECTRON BEAM

BACKGROUND OF THE INVENTION

1. Field of the Invention

The present invention relates to a direct-heated flat emitter for creating an electron beam, particularly for x-ray tubes, with two terminal lugs formed at the edge of the perimeter for the heat supply.

2. Description of the Prior Art

For mammography there are x-ray tubes with rectangular surface emitters consisting of tungsten sheet that is about 50 μm thick. These flat emitters are provided with mutually parallel slits proceeding in alternating fashion from mutually opposite sides, so that interconnects are formed which produce a serpentine current path that enables a direct heating of the flat emitter.

Flat emitters are also known from French Patent 58 949, French Patent 978 627, British Specification 10 11 398, German OS 37 17 974 and German PS 39 01 337.

Such emitters share the problem that an electron beam having an optimally homogenous electron distribution over its cross-section can only be generated if the slits are very narrow. The slits cannot be made arbitrarily narrow, however, there is the danger of shorts between neighboring interconnects. Besides this, there is the danger of voltage arcing between neighboring interconnects. Both lead to a shortening of the lifetime of the flat emitter or even to its premature failure.

SUMMARY OF THE INVENTION

It is an object of the present invention to provide a flat emitter of the above type having a structure which allows a longer lifetime for the emitter to be achieved.

This object is inventively achieved in a flat emitter with a slitted emission surface wherein the slits have a width of no less than 10 μm and no greater than 1% of the length of a diagonal of the smallest rectangle which can circumscribe the emission surface.

Shorts and voltage arcing between neighboring interconnects are thus precluded, which is a precondition for a longer lifetime. It is also guaranteed that the cuts do not have a width which causes undesirable non-homogeneities to arise in the electron beam emanating from the emission surface.

The above object also is inventively achieved in a flat emitter having a round i.e. a substantially annular emission surface wherein the slits proceed such that each right-proceeding interconnect curve is followed by a left-proceeding interconnect, and each left-proceeding interconnect curve is followed by a right-proceeding interconnect.

It is assured in this way that, unlike in the case of a flat emitter described in British Specification 1 011 398 which is fashioned as double-threaded spiral, for example, the potential difference between immediately neighboring interconnects decreases. This leads to a low danger of voltage arcing, thereby preconditioning a longer lifetime.

If the interconnects have different electrical resistances, local "hot spots" or "cold spots" and thus a correspondingly different electron emission depending on resistance value can occur. To avoid this, in a version of the invention path exhibited by the slit at least partially conforms to the peripheral shape of the flat detector, and preferably such that the interconnects thus created have substantially the same electrical resistance over the entire emission surface.

In contrast to the known arrangements, there is a different current flow in the interconnects of the emitter formed by the slits because of the arrangement of the two terminal lugs formed at the outer edge (which should preferably be diametrically opposed) so that a uniform heating of all regions of the emission surface of the emitter and thus a very homogenous electron beam and guaranteed. This is true particularly for the central region of the emitter, which is not a point of origin for any of the electrical terminals. (The term "point of origin" as used herein means an originating or connection location (i.e. a "root") of the terminal lug relative to the emission surface, which will not literally be a single point.)

The flat emitter is preferably annular with two opposing concentric curved slit pairs connected at one end to each other and to the point of origin of one of the terminal lugs by straight slits, these lugs being arranged diametrically to each other and offset 90° relative to the connecting line of the midpoints of the curved slits. Due to these curved slits and the few short straight connecting slits, a very good division of a round emission surface can be achieved, so that there are equal conductor widths and thus equal electrical resistances at practically all points. This in turn results in a uniform temperature of the entire emission surface and thus the generation of a homogenous electron beam.

The curved slits of each pair should preferably span different angles, with the center of the emission surface coinciding with the apex of these angles. It has further proven appropriate for the radii of the inner curved slits to be substantially ⅕ of the radius of the emission surface, and the radii of the outer curved slits are substantially ⅗ of the emission surface radius.

To prevent significant gradients of the emitter temperature in the regions of the respective points of origin of the terminal lugs due to the necessarily occurring heat runoff into the mounting rods which provide the current supply and thus to avoid non-homogeneities of the electron beam in this region, in a further embodiment of the invention each region of the point of origin of a terminal lug has a width which is modified relative to the interconnects of the emission surfaces and which balances the thermal conduction losses.

DESCRIPTION OF THE PREFERRED EMBODIMENT

Figure 1:
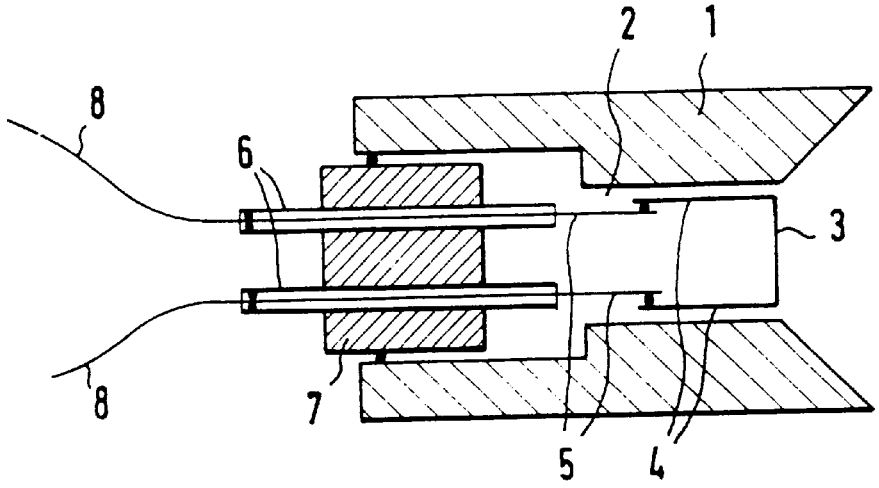
FIG. 1 is a schematic section through the cathode of an electron beam tube with a direct-heated flat emitter in accordance with the invention arranged inside a Wehnelt cylinder.

The cathode schematically depicted in FIG. 1 has a Wehnelt cylinder 1 with a central bore 2 in which an annular direct-heated flat emitter 3 is arranged. The emitter 3 has a terminal lug 4 formed thereon, these being welded onto the current supply rods 5 and serving for mechanical mounting of the flat emitter 3 in addition to the current supply. The current supply rods 5 are led from an insulating part 7 to the exterior via tubes 6 and connected at the exterior with electrical terminal wires 8 in known fashion (not depicted in detail). In order to obtain an optimally homogenous electron beam, the annular surface of the emitter 3 is divided by two curved slit pairs 9, 10 and 9', 10' (the two curved slits of each pair span different midpoint angles). The slits of the pairs are disposed concentrically relative to the midpoint of the emitter 3. The ends of the respective outer curved slits 9, 9' and of the inner curved slits 10', 10 of the other pair which ends reside on the same side with respect to the diametrically opposed terminal lugs 4 are connected to each other by straight slits 11, 11' and to the point of origin of one of the terminal lugs 4 by other straight slits 12, 12'. This results in a configuration with the desired uniform width of the interconnects formed by the slits, with a uniform resistance and consequently a uniform temperature on the basis of the current flow through the direct-heated emitter 3.

Narrowed width regions indicated in dashed lines at the point of origin of each of the terminal lugs 4. The narrowed width regions can extend a greater or lesser distance beyond the length of the terminal lugs 4, this distance being selected after experimentation such that a compensation of the thermal conduction losses into the rods 5 (current supply) is achieved by an optimized width of the terminal lugs 4.

Figure 2:
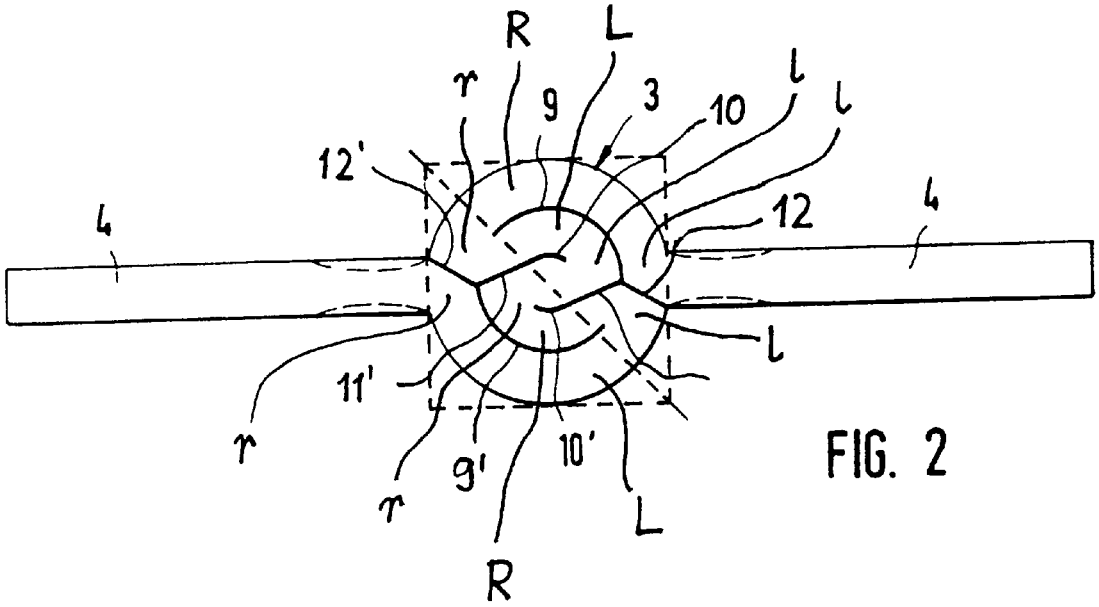
FIG. 2 is a plan view of the flat emitter in accordance with the invention before the bending of the terminal lugs to form the mounting legs.

As can be seen in FIG. 2, the slits 9 to 12 and 9' to 12' are such that, proceeding from the left terminal lug 4 in FIG. 2, a right-proceeding interconnect curve R1 is followed by a left-proceeding interconnect $L_1$, followed by a central region 6, and another left-proceeding interconnect curve $L_2$ is followed by another right-proceeding interconnect curve R2.

It is thus guaranteed that the potential difference between neighboring interconnects—and thus the danger of voltage arcing—is low. Increased potential differences relative to the terminal lugs 4 arise in the region of the slits 12 and 12', for which reason the slits 12 and 12' are fashioned with correspondingly larger widths than the remaining slits (not depicted).

The innermost left interconnect curve L1 can be connected to the innermost left interconnect curve L2 either directly in the central region C or with the insertion of a short linear interconnect, or even with the insertion of a short interconnect that is bent to the right at which a short interconnect that is bent to the right is attached. Whatever connection is used in the central region C, as shown in FIG. 2 it will be a generally right-proceeding connection (according to the above nomenclature), so that the right-left alternation is preserved.

The remaining slits 9 to 11, and 9' to 11', each have a width that is at least equal to 10 $\mu$m and at the most equal to 1% of the length of the diagonal of the smallest rectangle which can circumscribe the emission surface, which is drawn in FIG. 2 with the diagonal in dashed fashion.

In this way, in the interest of a longer lifetime, the occurrence of shorts and voltage arcing between neighboring interconnects is precluded. The emanation of a non-homogenous electron beam from the emission surface due to an excessively large width of the slit is simultaneously precluded.

Due to the small width the slits 9 to 11, and 9' to 11' are depicted in FIG. 1 as simple lines.

In the exemplary embodiment, as a result of the annular shape of the flat emitter 3 the smallest circumscribable rectangle for the emission surface is a square. In contrast, in the case of an elliptical flat emitter, for example, the smallest circumscribable rectangle for the emission surface would be a rectangle whose larger lateral length would correspond to the length of the major of the ellipse, and whose smaller lateral length would correspond to the minor axis of the ellipse.

The invention is not limited to the exemplary embodiment. It is thus also possible to inventively fashion flat emitters with an outer contour that deviates from the annular outer contour provided in the exemplary embodiment.

Emitters considered flat emitters in the framework of the invention are those wherein the electrons emanate from a preferably flat, but possibly bent region which, unlike in wire filaments, is fashioned in planar fashion, namely as emission surface.

Although modifications and changes may be suggested by those skilled in the art, it is the intention of the inventors to embody within the patent warranted hereon all changes and modifications as reasonably and properly come within the scope of our contribution to the art.

What is claimed is:

1. A direct-heated flat emitter for generating an x-ray beam comprising an emission surface having a plurality of slits therein and a peripheral edge, two terminal lugs for supplying heating current connected at said peripheral edge of said emission surface, and said slits in said emission surface having a width of no less 10 micrometers and no larger than 1% of a length of a diagonal of a smallest rectangle which can circumscribe said emission surface.

2. A direct-heating flat emitter as claimed in claim 1 wherein said emission surface is substantially annular in shape, and wherein said slits comprise serpentine slits dividing said emission surface into a plurality of interconnects alternately connected to each other in succession by right-proceeding interconnect curves and left-proceeding interconnect curves, and wherein each right-proceeding interconnect curve is followed by a left-proceeding interconnect and each left-proceeding interconnect curve is followed by a right-proceeding interconnect.

3. A direct-heated flat emitter as claimed in claim 1 wherein said slits proceed along a path at least partially conforming to a shape of said peripheral edge.

4. A direct-heated flat emitter as claimed in claim 1 wherein said interconnects each have substantially equal electrical resistance over said emission surface.

5. A direct-heated flat emitter as claimed in claim 1 wherein said terminal lugs extend from and are attached to said emission surface at respective points of origin at said peripheral edge, the respective points of origin being diametrically opposite each other, and wherein said emission surface is substantially annular, and wherein said slits comprise:

a first pair of first and second opposed, concentric curved slits;

a second pair of first and second opposed, concentric curved slits, said second pair of slits being disposed within a region of said emission surface at least partially surrounded by said first pair of slits;

a first straight slit proceeding from one of said points of origin and connecting a first slit in said first pair to a first slit in said second pair; and a second straight slit proceeding from the other of said points of origin and connecting said second slit in said first pair to said second slit in said second pair.

6. A direct heated flat emitter as claimed in claim 5 wherein said first and second slits of said first pair span a first angle and wherein said first and second slits of said second pair span a second angle, said first and second angles being different and each having an apex at a center of said emission surface.

7. A direct heated flat emitter as claimed in claim 6 wherein said emission surface has an emission surface radius and wherein said first and second slits in said second pair each has a radius which is substantially ⅕ of said emission surface radius, and wherein said first and second slits of said second pair each have a radius which is substantially ⅗ of said emission surface radius.

8. A direct heated flat emitter as claimed in claim 6 wherein said emission surface has an emission surface radius and wherein said first and second slits in said second pair each has a radius which is substantially ⅕ of said emission surface radius, and wherein said first and second slits of said second pair each have a radius which is substantially ⅗ of said emission surface radius.

9. A directed heated flat emitter as claimed in claim 1 wherein said terminal lugs each have a narrowed width adjacent a region of connection of the terminal lugs with said emission surface for balancing thermal conduction losses.

10. A direct heated flat emitter for generating an electron beam, comprising:

an emission surface having slits therein dividing said emission surface into serpentine interconnects, said emission surface having a substantially annular peripheral edge, said interconnects being connected in alternating fashion by right-proceeding interconnect curves and left-proceeding interconnect curves, with each right-proceeding interconnect curve being followed by a left-proceeding interconnect and each left-proceeding interconnect curve being followed by a right-proceeding interconnect; and two terminal lugs attached at said peripheral edge of said emmision surface for supplying heating current, said terminal lugs each having a narrowed width adjacent a region of connection of the terminal lugs with said emmision surface for balancing thermal conduction losses.

11. A direct-heated flat emitter as claimed in claim 10 wherein said slits proceed along a path at least partially conforming to a shape of said peripheral edge.

12. A direct-heated flat emitter as claimed in claim 10 wherein said interconnects each have substantially equal electrical resistance over said emission surface.

13. A direct-heated flat emitter as claimed in claim 10 wherein said terminal lugs extend from and are attached to said emission surface at respective points of origin at said peripheral edge, the respective points of origin being diametrically opposite each other, and wherein said slits comprise:

a first pair of first and second opposed, concentric curved slits;

a second pair of first and second opposed, concentric curved slits, said second pair of slits being disposed within a region of said emission surface at least partially surrounded by said first pair of slits;

a first straight slit proceeding from one of said points of origin and connecting a first slit in said first pair to a first slit in said second pair; and a second straight slit proceeding from the other of said points of origin and connecting said second slit in said first pair to said second slit in said second pair.

14. A direct heated flat emitter as claimed in claim 13 wherein said first and second slits of said first pair span a first angle and wherein said first and second slits of said second pair span a second angle, said first and second angles being different and each having an apex at a center of said emission surface.

15. A direct heated flat emitter as claimed in claim 14 wherein said emission surface has an emission surface radius and wherein said first and second slits in said second pair each has a radius which is substantially ⅕ of said emission surface radius, and wherein said first and second slits of said second pair each have a radius which is substantially ⅗ of said emission surface radius.

16. A direct heated flat emitter as claimed in claim 13 wherein said emission surface has an emission surface radius and wherein said first and second slits in said second pair each has a radius which is substantially ⅕ of said emission surface radius, and wherein said first and second slits of said second pair each have a radius which is substantially ⅗ of said emission surface radius.

* * * * *